United States Patent [19]

McCready

[11] Patent Number: 4,888,122

[45] Date of Patent: Dec. 19, 1989

[54] ENGINE OIL ADDITIVE DRY LUBRICANT POWDER

[76] Inventor: David F. McCready, P.O. Box 1971, Altoona, Pa. 16603

[21] Appl. No.: 933,940

[22] Filed: Nov. 24, 1986

[51] Int. Cl.[4] ..... C10M 125/10; C10M 147/02

[52] U.S. Cl. ..... 252/25; 252/12.2; 252/58

[58] Field of Search ..... 252/25, 12.2, 58

[56] References Cited

U.S. PATENT DOCUMENTS

| | | | |
|---|---|---|---|
| 3,202,626 | 8/1965 | FitzSimmons | 252/25 |
| 3,380,843 | 4/1968 | Davis | 252/12.2 |
| 3,691,074 | 9/1972 | Messina | 252/25 |
| 3,788,987 | 1/1974 | Bartlett | 252/25 |
| 3,879,301 | 4/1975 | Cairns | 252/12 |
| 3,896,036 | 7/1975 | Cairns | 252/12 |
| 3,994,814 | 11/1976 | Cairns | 252/12 |
| 4,414,241 | 11/1983 | Quella et al. | 255/25 |
| 4,584,116 | 4/1986 | Hermant et al. | 252/25 |
| 4,615,817 | 10/1986 | McCoy | 252/51.5 R |
| 4,626,365 | 12/1986 | Mori | 252/12.2 |
| 4,655,944 | 4/1987 | Mori | 252/12.2 |
| 4,655,945 | 4/1987 | Balsells | 252/12.2 |

*Primary Examiner*—William R. Dixon, Jr.
*Assistant Examiner*—E. McAvoy
*Attorney, Agent, or Firm*—James Creighton Wray

[57] ABSTRACT

An engine oil additive in the form of a dry lubricant powder having approximately equal parts of Dupont DLX-6000, an experimental grade fluorocarbon resin micropowder having particle size less than a micron and having a recommended temperature range of about 480 degrees F. and a Colt Industries Plastomer Products Division Plastolon P-550 Teflon powder having a micron to submicron size and having a recommended operation maximum range of from about 500 to about 660 degrees F. and about 1–2% titanium dioxide is added to an engine oil by draining used engine oil, renewing filtration system, pouring one pint of new engine oil into filler opening, mixing second pint with the prescribed ratio of Power Powder and pouring into the engine filler opening, filling with additional oil needed to bring engine oil capacity to full, and immediately operating the engine through its normal driving manner for approximately 30 minutes. The fluid lubricants carry the powder components in their powdered form to friction bearing surfaces where powder is squeezed from the lubricant to impregnate the porous surfaces. The dry lubricant rapidly increases in temperature as it contacts the porous friction surfaces and adheres to the surfaces. The friction smooths the lubricant over the surfaces, increasing the slip characteristics of the load bearing surfaces and reducing vibration characteristics that would otherwise tend to disrupt fluid lubricant barriers.

12 Claims, No Drawings

ENGINE OIL ADDITIVE DRY LUBRICANT POWDER

BACKGROUND OF THE INVENTION

Teflon is recognized as a low coefficient-of-friction material when used as a solid bearing surface coating. When granulated to the size of from about 1 to about 20 microns in size, aqueous suspensions of Teflon have been blended with surfactants and base lubricants to make the Teflon useable in crank case lubrication systems.

One of the problems associated with the crank case lubrication system is the agglomerating of the granulated Teflon and the precipitation of the Teflon so that the Teflon tends to occupy a layer in the crank case. Once agglomerated, it is difficult to break up the Teflon. Although the mechanics of the prior art disadvantageous agglomeration of Teflon are not precisely known, it is believed that in use the aqueous suspension of Teflon and the surfactants to make the aqueous suspensions compatible with the base lubricants and the crank case oil rapidly lose their water when heated at operating temperatures. The loss of the water makes the surfactants ineffective and the dry lubricant components may never be returned to suspension. Whether the surfactants break down and disappear may be a moot question because once the water is gone, the surfactants, whose purpose is to attach water and oil molecules, have no further use.

The suspension mediums of liquid based additives which contain fluorocarbon powder products add unnecessary expense to the products. The suspension mediums cause storage problems in the liquid products which tend to settle before they are used and require vigorous shaking to resuspend the aqueous suspensions of the fluorocarbon resin particles in the water-base lubricant emulsions.

A need exists for a delivery system to deliver solid lubricant particles directly to surfaces to be lubricated while preventing agglomeration of the particles in crank cases.

SUMMARY OF THE INVENTION

An engine oil additive in the form of a dry lubricant powder having approximately equal parts of Dupont DLX-6000, a polytetrafluoroethylene (PTFE) having particle size less than a micron and having a recommended temperature range of about 480 degrees F. and a Colt Industries Plastomer Products Division Plastolon P-550 Teflon powder having a micron to submicron size and having a recommended operation maximum range of from about 500 to about 660 degrees F. and about 1–2% titanium dioxide is added to an engine oil through the dipstick sump port and through the valve cover filler opening while an engine is operating at temperature. The fluid lubricants carry the powder components in their powdered form to friction bearing surfaces where powder is squeezed from the lubricant to impregnate the porous surfaces. The dry lubricant rapidly increases in temperature as it contacts the porous friction surfaces and adheres to the surfaces. The friction smooths the lubricant over the surfaces, increasing the slip characteristics of the load bearing surfaces and reducing vibration characteristics that would otherwise tend to disrupt fluid lubricant barriers.

An engine oil additive comprises about 50% of submicron fluorocarbon resin powder having a temperature withstanding capability of about 480 degrees F. and about 50% by weight of a granulated Teflon powder capable of withstanding a temperature of about 600 degrees F. and having a micron to submicron size and about 1% titanium dioxide. ($TiO_2$) boosts the temperature range of the combination.

The fluorocarbon resin micropowder exists in a size from about 0.5 microns to less than 1 micron.

The second component exists in a form of powder having a size in the micron to submicron range greater than a size of the first component.

The engine oil dry lubricant powder comprises a dry powder form of two fluorocarbon resin micropowder components, the first component comprising a smaller powder having a size less than a micron and having a normal specified operating range of up to 480 degrees F. and the second component comprising a Teflon powder having a larger size in the micron to submicron range and having a higher normally recommended operational range of about 500 to about 660 degrees F. and the second component having about 1 to 2% titanium dioxide.

The first component comprises Dupont product DLX-6000 and the second product comprises Colt Industries Plastomer Products Division Plastolon P-500.

The method of engine lubricating comprises starting the engine and running the engine and bringing the engine to operating temperature, draining the used lubricant and renewing filtration system, and adding dry powder engine oil additive to the new engine oil, the dry powder engine oil additive comprising approximately equal parts of a fluorocarbon resin micropowder having less than micron size and having a lower recommended operating temperature and a dry Teflon powder having a size larger than the first component and being in the micron to submicron range and having a recommended operating temperature higher than the recommended temperature of the first component and being in the range of about 500–600 degrees F.

Adding the dry powder to the engine oil comprises placing the desired portion of the dry powder in one pint of the new engine oil and mixing or agitating the combination, then pouring the combination into oil filler openings.

These and further and other objects and features of the invention are apparent in the disclosure which is the above and ongoing specification, including the claims.

DETAILED DESCRIPTION OF THE INVENTION

The present invention is designed to overcome problems with the prior art in which lubricant additives contained materials which tended to interfere with the lubricant characteristics of the lubricant being used, for example, water in the aqueous suspensions which tended to cause rust on exposed surfaces and which tended to cause steam upon approaching hot surfaces which may scour the surfaces of lubricant or interfere with the lubricant coatings or which may cause vibration and attendant lubricant coating dimunitions or which may tend to condense on cooler surfaces. Often, the water is lost in use resulting in the destruction of the aqueous suspension characteristics of the product and resulting in agglomeration.

Because the prior art systems included lubricant powder in aqueous suspensions, the amount of suspension medium required to be added to crank cases reduced the effective amount of conventional lubricant carried in the crank cases and reduced the attendant lubrication of those eliminated lubricants.

In the present invention, dry lubricant is added directly to the conventional lubricant within the engine. No unusual suspension medium needs to be added to displace the conventional lubricant.

In the prior art systems, the suspension medium was often added to a full engine oil sump, thus creating an overfilled condition in which the engine oil lubricant and the added suspension medium interfered with normal operation of the engine, tending to reduce the effective contribution of the engine oil to the operation of the engine.

In systems of the prior art, when containers of aqueous suspensions, surfactants and emulsions were stored, the powders tended to precipitate from the suspensions making the pouring of the suspensions into the lubricant difficult and incomplete. The present invention has eliminated all of these problems by pouring a dry powder directly into a portion of the engine oil prior to filling the engine with lubricant. To use Power Powder: First, drain used engine oil and renew filtration system. Second, pour one pint of new engine oil into filler opening. The second pint will be mixed with the prescribed ratio of Power Powder, then the combination poured into the engine filler opening. Follow with the additional oil needed to bring the engine oil capacity to full. Third, immediately operate the engine through its normal driving manner for approximately 30 minutes. The dry powder is carried by the engine oil to friction surfaces where the powder immediately tends to soften and stick to the surface with friction on the surface tending to locally heat the powder and to soften the powder and to polish the powder into a lubricating glaze on the friction surfaces. The powder lubricant of the present invention tends to move in the violently turning sump to the powder metal surfaces and to splash lubrication to the cylinder walls where the powder is melted and fused into coatings of the porous material.

The present invention uses in at least half of its composition a PTFE micropowder having particle sizes of less than a micron and being at the time of this disclosure the smallest particle size of fluorocarbon products produced by Dupont.

The particular material which is identified by Dupont as DLX-6000 has a recommended temperature range which is lower than known Teflon recommended ranges. DLX-6000 has a recommended range of 480 degrees C and is not recommended by Dupont for use as an engine additive. The precise reason why the DLX-6000 product is not recommended for use as an engine additive is not readily known. It appears that that reason is related to the extremely small particle size and the relatively low recommended high temperature range of operation, which is about 480 degrees F. It is believed that the DLX-6000 powder when used in previously known engine oil additive lubricant systems has higher tendencies to the disadvantageous agglomeration because of its small particle size.

In contrast to the recommendations, the small particle size is used by the present invention to make the powder rapidly adhere to the smallest surface irregularities in the friction surfaces which it encounters.

It is believed that the unusually small size of that product is made advantageous in the present invention by the combining of that product with a substantially equal amount of a Teflon powder which, while still small in size, has a larger size than the DLX-6000 and has a higher upper end of recommended operational temperature ranges. The particular product which the present invention mixes in equal parts with the Dupont DLX-6000 is a Colt Industries Plastomer Products Plastolon P-550 which has particle sizes in the micron to submicron size and which has maximum temperature operations recommended at about 500 degrees F. with intermittent usage high temperature ranges of about 660 degrees F. Contained within the Plastolon P-550 is a minor amount of titanium dioxide in about 1 to 2% by weight or up to about 1% by weight of the total product.

While an understanding of the actual operation of the product is not necessary to an understanding of the results of the product, it is believed that the titanium dioxide forms a glaze upon the high temperature metal surfaces which it encounters and that the DLX-6000 rapidly coats and fuses in the porous friction surfaces in the engine and that the P-550 product heats and fuses with slightly less rapidity and that the titanium dioxide forms a glaze upon the surfaces and that all of the components cooperate to spread over the friction surfaces in fine coatings.

Because the present powders are added to the engine oil when hot or during a brief interruption in operation to add the powders, the powders do not agglomerate in the crank case or in other areas where oil tends to collect but rather move quickly to the high temperature friction surfaces where they deposit.

EXAMPLE:

Equal amounts by weight of Dupont DLX-6000 and Plastolon P-550 having submicron particle sizes and containing about 1% titanium dioxide are mixed together.

An automobile having a four-quart engine oil lubrication system which has been provided with a new conventional engine oil filter has one pint of new oil added to the engine. A second pint is used to blend with the powder at a ratio of 2 ounces of powder to 4–5 quarts of oil. The blend of powder and oil are added to the engine immediately followed by the remaining 3–4 quarts of new oil. The engine is operated for 30 minutes. The cap is replaced and the engine is restarted and the automobile is driven in normal traffic conditions for at least 30 minutes before shutting off the engine.

EXAMPLE 2:

The same procedures in Example 1 are followed except that instead of adding powder in the opening in the valve cover, 2 ounces of powder-oil blend are inserted through a funnel into the crank case whereupon the engine is immediately restarted and run for at least 30 minutes before it is shut off.

EXAMPLE 3:

The same procedures for Examples 1 and 2 except that 1 ounce of the dry powder-oil blend is placed in the valve cover opening and 1 ounce of the powder-oil blend is introduced through the dipstick tube directly into the crank case sump. The engine is restarted and run for at least 30 minutes before it is shut off.

The present invention provides unusually fine dry lubricants which are unencumbered by suspension systems and which are rapidly carried to hot engine surfaces and plated thereon.

I claim:

1. A dry engine oil additive consisting of,
about 50% by weight of a submicron sized first polytetrafluoroethylene (PTFE) powder,
about 50% by weight of a granulated second polytetrafluoroethylene (PTFE) powder capable of withstanding a higher temperature than the first PTFE powder and having a micron to submicron size, and
about 1% by weight Titanium dioxide.

2. The engine oil additive of claim 1 wherein the first PTFE powder has a particle size from about 0.5 microns to less than 1 micron.

3. The engine oil additive of claim 1 wherein the second PTFE powder has a size in the micron to submicron range but greater than the size of the first PTFE powder.

4. The engine oil additive of claim 1 wherein the first PTFE powder comprises Dupont product DLX-6000 and wherein the second PTFE powder comprises Colt Industries Plastomer Products Division Plastolon P-500.

5. The engine oil additive of claim 1
wherein the first PTFE powder has a temperature withstanding capability of about 480 degrees F.

6. The engine oil additive of claim 5 wherein
the second PTFE powder has a temperature withstanding capability of about 600 degrees F.

7. The engine oil additive of claim 5 wherein the second PTFE powder has a temperature withstadning capability of about 500 to about 660 degrees F.

8. The method of engine lubricating comprising,
running the engine to achieve a normal operating temperature, wherein the engine contains a sump supply of lubricating oil,
stopping the engine,
draining the lubricating oil,
adding a new supply of lubricating oil to the engine
adding titanium dioxide and PTFE dry powdered particles having a size ranging from submicron to micron size to the new supply of oil, and
running the engine for a time sufficient to cause at least some of the powdered PTFE particles to adhere to friction surfaces of the engine.

9. The method of claim 8 wherein adding the dry powder to the engine oil comprises placing a portion of the dry powder in an oil filler opening as provided by the specific engine manufacture in a valve cover.

10. The method of claim 9 wherein adding the dry powder comprises placing a portion of the dry powder in the sump through any engine opening.

11. The method of claim 8 wherein dry powdered PTFE particles comprises approximately equal parts of a first PTFE powder having less than micron size and a second PTFE powder having a larger particle size than the first PTFE powder and being in the micron to submicron range and having a recommended operating temperature higher than the recommended temperature of the first PTFE powder and being in the range of 500–600 degrees F.

12. A method of using dry powdered PTFE particles and titanium dioxide comprising,
adding the quantity of powder and titanium dioxide to an engine while the engine is at running temperature, along with a sump supply of oil, and
running the engine for a time period sufficient to work smaller submicron sized particles into lubricated surfaces.

* * * * *